United States Patent [19]

Coleman et al.

[11] 3,938,736

[45] Feb. 17, 1976

[54] FUEL PUMP COMPUTER CONVERSION MEANS

[75] Inventors: Arthur Coleman, Dundee, Scotland; Ronald M. Garland, Ashhurst Wood, England

[73] Assignee: Veeder Industries, Inc., Hartford, Conn.

[22] Filed: Sept. 6, 1974

[21] Appl. No.: 503,613

[52] U.S. Cl. ..... 235/94 R; 235/61 L

[51] Int. Cl.[2] ..... G06C 15/42; B67D 5/22

[58] Field of Search .... 235/94 R, 94 A, 61 L, 61 M

[56] References Cited

UNITED STATES PATENTS 3,355,100 11/1967 Sundblom ..... 235/61 M 3,863,839 2/1975 Batson ..... 235/94 R

*Primary Examiner*—Stephen J. Tomsky

*Attorney, Agent, or Firm*—Prutzman, Hayes, Kalb & Chilton

[57] ABSTRACT

A modified mechanical gasoline pump computer with an input gear box mounted on the underside of the base of the computer variator. A depending gear box input shaft is coupled to be driven by the gasoline meter and is axially shiftable for axially shifting gear box output gearing mounted on the variator center shaft upwardly from a gallon unit volume measure gear ratio setting to an alternate quart or liter unit volume measure gear ratio setting.

10 Claims, 2 Drawing Figures

FUEL PUMP COMPUTER CONVERSION MEANS

SUMMARY OF THE INVENTION

The present invention relates generally to conventional mechanical fuel pump computers of the type employed in gasoline dispensing apparatus for establishing and posting a unit volume price for a gallon of fuel, registering the volume of fuel delivered in gallons and computing and registering the cost of fuel delivered in dollars and cents ( and employing, for example, a mechanical register of the type shown and described in U.S. Pat. No. 2,814,444 of Harvey N. Bliss dated Nov. 26, 1957 and entitled "Register" and a mechanical variator of the type shown and described in U.S. Pat. No. 3,413,867 of Richard B. Hamlin dated Dec. 3, 1968 and entitled "Variator") and relates more particularly to the selective conversion of such mechanical fuel pump computers for establishing and posting a unit volume price of fuel for a quart, liter or other alternate unit volume measure, registering the volume of the fuel delivered in the alternate unit volume measure and registering the cost of the fuel delivered in dollars and cents in accordance with the volume of fuel delivered in the alternate unit volume measure and the posted unit volume price for the alternate measure.

The conventional mechanical fuel pump computer incorporates a mechanical register having a pair of counters on each of two opposite faces of the register for registering, on each of the opposite faces, the cost of fuel delivered in dollars and cents and the volume of fuel delivered in gallons. Such a register is shown in the aforementioned U.S. Pat. No. 2,814,444. The fuel pump computer also incorporates a mechanical variator of the type disclosed in the aforementioned U.S. Pat. No. 3,413,867 for establishing and posting the unit volume price for a gallon of fuel. The variator is connected for being mechanically driven by a conventional gasoline meter so that the variator center shaft is rotated four revolutions for each gallon of fuel delivered, and the variator is connected for driving the volume and cost counters of the register for registering the volume amount of fuel delivered in gallons and the cost amount of fuel delivered in dollars and cents in accordance with the volume amount of fuel delivered in gallons and the gallon unit volume price established by the variator setting.

Because of the increasing cost of gasoline, the price of a gallon of gasoline may now exceed the maximum range of 49 and 9/10 cents of conventional limited range variators in the field and in the not too distant future may exceed the maximum range of 99 and 9/10 cents of conventional greater range variators in the field. Also, consideration is being given to the conversion of the present measuring system to the metric system in which event the present gallon unit volume measure used in the fuel pump computer may by requirement or choice be changed to a liter unit volume measure. Because of one or both of the foregoing considerations, it may become desirable or mandatory to convert existing mechanical fuel pump computers from the present gallon unit volume measure system to a quart, liter or other unit volume measure system.

It is, therefore, a principal aim of the present invention to provide conversion means for selectively converting when desired conventional mechanical fuel pump computers for establishing and posting a unit volume price in quarts, liters or other alternate unit volume measure for registering the volume amount of the fuel delivered in the alternate unit volume measure and registering the cost amount of the fuel delivered in dollars and cents in accordance with the volume amount delivered in the alternate unit volume measure and the price for the alternate unit volume measure established by the setting of the variator.

It is another aim of the present invention to provide new and improved conversion means of the type described which permits field conversion of existing conventional computers with minimum inconvenience and down time.

It is another aim of the present invention to provide new and improved conversion means of the type described which may be economically mass produced and which will provide reliable operation over a long service free life.

It is a further aim of the present invention to provide new and improved selectively operable conversion means for a mechanical gasoline pump computer settable for establishing a gallon unit volume price and for registering the volume amount of fuel delivered in gallons in the conventional manner or settable for establishing a unit volume price for a quart, liter or other selected unit volume measure and for registering the volume amount of fuel delivered in the selected unit volume of measure.

It is another aim of the present invention to provide new and improved selectively settable conversion means for a gasoline pump computer which may be selectively set from a gallons setting to alternate unit volume measure setting when desired and which cannot be reset to its gallon setting after a changeover to the alternate unit volume measure setting is made.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
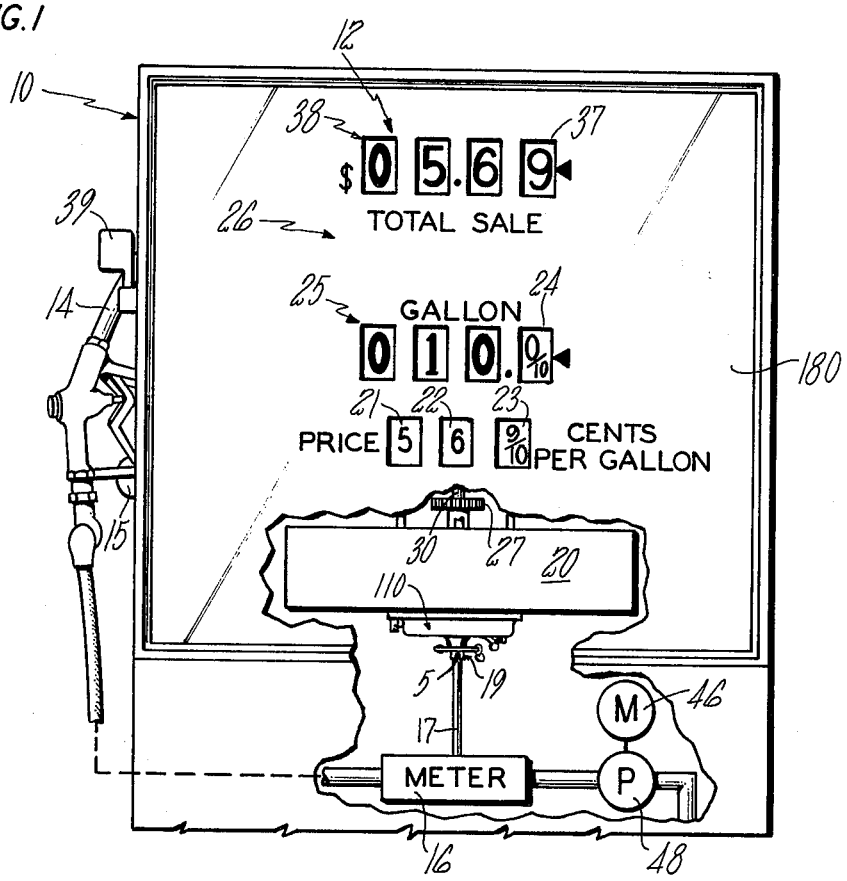
FIG. 1 is a partial front elevation view, partly broken away and partly in section, of a fuel pump having a mechanical computer modified in accordance with the present invention.

Referring now to the drawings in detail wherein like reference numerals indicate like parts throughout the several figures, a gasoline delivery pump 10 employing a mechanical computer 12 incorporating an embodiment of the present invention is shown having a nozzle 14 for delivering fuel and a suitable nozzle storage receptacle 15 for storing the nozzle 14 between fuel deliveries. In a conventional manner, a meter 16 provided in the fuel delivery conduit has a rotary output shaft 17 driven in accordance with the volume amount of fuel delivered. The meter shaft 17 is connected via a coupling 5 to a depending input shaft 19 of a modified variator 20 for rotating the variator input shaft 19 at a rate of four revolutions per gallon of fuel dispensed. The coupling 5 comprises a drive coupling member 6 with a transverse drive pin 7 and a driven coupling member 8 having diametrically opposed slots 9 for receiving the drive pin 7. Excepting as modified as hereinafter described, the variator 20 is of the type described in the aforementioned U.S. Pat. No. 3,413,867 and comprises three settable range arms (not shown) of ascending order of significance which can be individually manually set into engagement with selected gear steps of a cone gear (not shown) to collectively establish the desired unit volume price of fuel within a three place price range. The variator also comprises three price posting wheels 21–23, corresponding to the three range arms, which are mechanically connected to the range arms to automatically post the unit volume price established by the settings of the range arms. The variator has a center shaft 30 which is driven by the variator input shaft 19 (as hereinafter described) and which extends through the variator and is mechanically connected for driving the lowest order counter wheels 24 of a pair of volume counters 25 of a resettable register 26 for registering the volume amount of fuel dispensed. A rotary output gear 27 of the variator rotatably mounted on the variator center shaft 30 is driven by the meter 16 via the variator cone gear and variator range arms in accordance with the established unit volume price. The output gear 27 is mechanically connected for driving the lowest order counter wheels 37 of a pair of register cost counters 38 for registering the cost amount of fuel dispensed in accordance with the unit volume price established by the range arm settings of the variator 20.

The resettable register 26 is of the type shown in the aforementioned U.S. Pat. No. 2,814,444 and is operable by a control handle 39 positioned adjacent the nozzle storage receptacle 15 such that the handle 39 has to be rotated to its vertical or "off" position to permit the nozzle 14 to be placed in its storage receptacle at the completion of a fuel delivery, and the nozzle 14 has to be removed from its storage receptacle 15 to permit the handle 39 to be rotated to its horizontal or "on" position. Rotation of the handle 39 to its vertical or "off" position provides for disengaging all of the number wheels for conditioning the register 26 for being reset, and rotation of the handle 39 to its horizontal or "on" position provides for sequentially resetting all of the number wheels of the cost and volume counters to zero and then re-engaging all of the wheels for re-conditioning the register 26 for registering the cost and volume of the succeeding fuel delivery. The register 26 is also connected in a known manner to provide for de-energizing a motor 46 for a pump 48 when the handle 39 is turned to its "off" position and for re-energizing the motor 46 after the volume and cost counters 25, 38 of the register 26 have been reset and the register is conditioned for recording the subsequent delivery.

As more fully described in the aforementioned U.S. Pat. No. 2,814,444 the register 26 comprises a pair of cost and volume counters 24, 38 on each of two opposed sides of the register (only one pair of cost and volume counters being shown in the drawings). The lowest order counter wheel of each cost counter 38 is mechanically connected to be driven by the meter 16 via the variator 20 for registering the cost of each fuel delivery, and the lowest order counter wheel of each volume counter 25 is mechanically connected to be driven by the meter 16 via the variator 20 for registering the volume of each fuel delivery.

The conventional mechanical computer of the type described is installed to establish and post the unit volume price of a gallon of fuel with the variator 20, register the volume of fuel delivered in gallons and compute the cost of fuel delivered in accordance with the volume delivered in gallons and the gallon unit volume price established by the variator setting.

In accordance with the present invention, the computer is modified for selectively converting the computer from a gallons computation and registration system to a quart, liter or other alternate unit volume measure computation and registration system wherein a unit volume price of the selected unit volume measure is established and posted with the variator 20, the volume amount of fuel delivered is registered in the alternate unit volume measure with the register 26, and the cost amount of fuel delivered is registered with the register 26 in accordance with the volume amount of fuel delivered in the alternate unit volume measure and the unit volume price of the alternate unit volume measure established by the variator setting.

Figure 2:
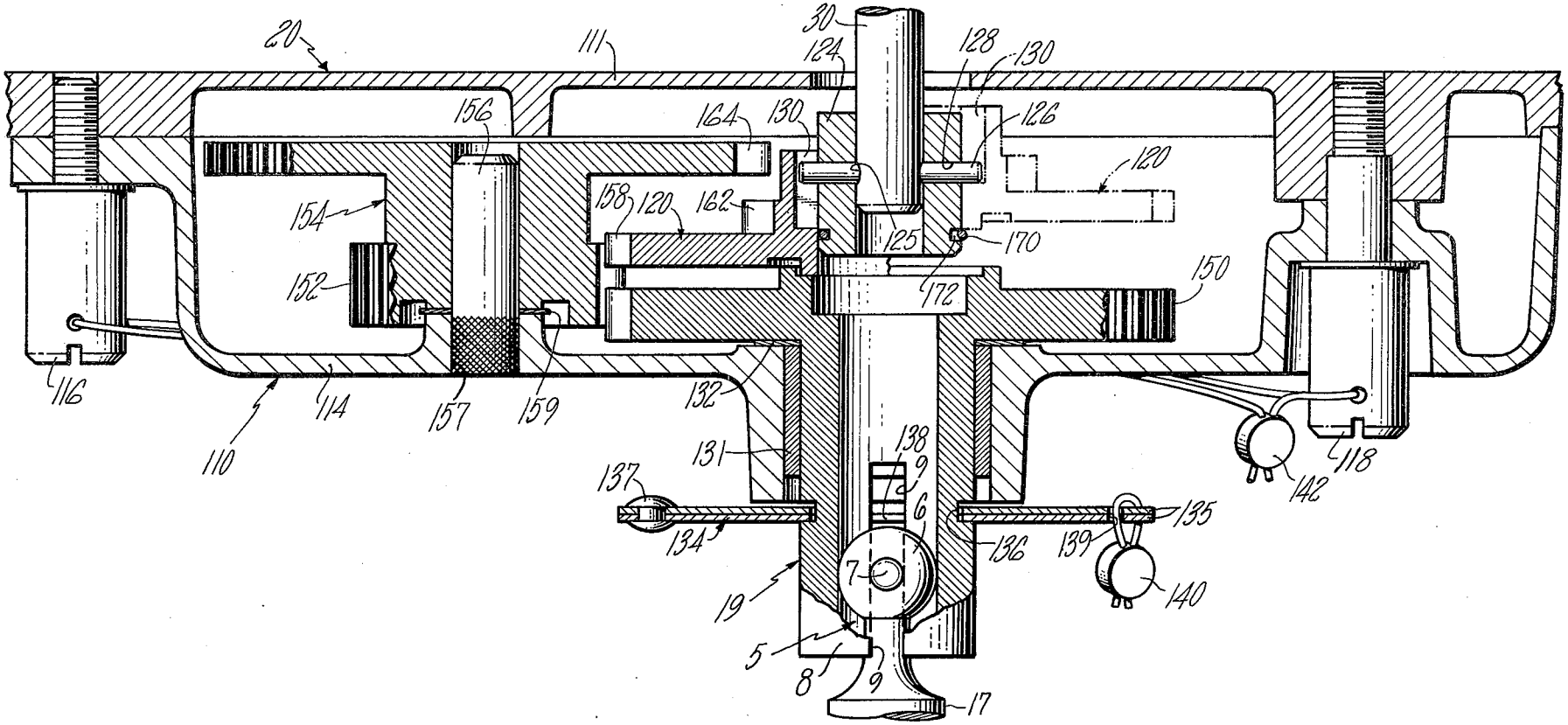
FIG. 2 is a partial enlarged elevation view, partly broken away and partly in section, of a modified variator of the mechanical computer.

In accordance with the present invention the variator 20 is modified to incorporate a selectively settable input gear box 110 on the underside of the conventional base 111 of the variator 20 as shown in FIG. 2. The input gear box 110 could be installed on the underside of the base 111 of the variator 20 when the variator is originally installed in the pump, and in any event the gear box 110 can be installed (e.g., in the field or at a variator manufacturing or repair facility) prior to the desired conversion of the computer. And, for the purpose of permitting advance installation of the gear box 110, the gear box 110 is preferably designed as hereinafter described to provide for gallons pricing and cost computation in the conventional manner.

Referring to FIG. 2, the gear box 110 is shown attached to the underside of the base 111 of a conventional variator (of the type described in the aforementioned U.S. Pat. No. 3,413,867). For that purpose, a gear box housing 114 of the gear box 110 is provided with openings for three angularly spaced threaded fasteners 116, 118 (only two being shown in the drawing) for securing the housing 114 to the underside of the conventional variator. The base 111 of the variator is formed to have conforming threaded openings either at the time of the installation of the gear box 110 or as part of the original manufacture or any subsequent repair or rebuilding operation of the variator.

The gear box 110 comprises an ouput compound gear 120 mounted on the lower depending end of the conventional variator center shaft 30 by means of an elongated support collar 124 lightly press fit onto the lower end of the variator center shaft 30. The usual variator coupling pin (not shown) is removed from an opening 125 extending transversely through the variator center shaft 30 and a substitute coupling pin 126 is lightly press fit through a transverse opening 128 in the support collar 124 and the variator center shaft opening 125 to extend within diametrically opposed axially extending slots 130 in the compound gear 120. The support collar 124, pin 126 and compound gear 120 are mounted on the variator center shaft 30 before the housing 114 is affixed to the underside of the variator base 111. The compound gear 120 is thereby keyed for driving the variator center shaft 30 and is yet adapted to be axially shifted on the collar 124 between a lower operating position (shown in part in full lines in FIG. 2) and an upper operating position (shown in part in broken lines in FIG. 2). The compound gear 120, in its lower operating position, is substantially below the lower end of the variator center shaft 30, and the elongated collar 124 is mounted to extend substantially below the center shaft 30 to adequately support the compound gear 120 in its lower operating position.

The depending gear box input shaft 19 is rotatably mounted on the housing 114 within a suitable bushing 131 so that it is substantially coaxial with the variator center shaft 30. The input shaft 19 is axially shiftable within its support bushing 131 and is normally held in its lower position in engagement with a suitable thrust or support washer 132 by its own weight. Also, a suitable locking ring 134 is mounted within a peripheral annulus 136 of the input shaft 19 to lock the input shaft 19 against substantial upward displacement. The shown locking ring 134 comprises a pair of super-imposed flat locking members 135 pivotally mounted together by a pivot pin 137. The flat locking members 135 have opposed slots 138, with semicircular inner ends, dimensioned for inserting the locking members 135 into the shaft annulus 136. Accordingly, the two super-imposed locking members 135 may be pivoted apart to remove the locking ring 134 from the input shaft 19 and be pivoted together to install the locking ring 134 on the input shaft 19. Also, the locking members 135 have apertures 139 which are aligned when the locking ring is closed for receiving a suitable seal 140. Thus, for example, the seal 140 can be applied by the proper authorities to the locking ring 134 to prevent unauthorized removal of the locking ring 134. A similar seal 142 is also preferably applied to the gear box fasteners 116, 118 by the proper authorities to prevent unauthorized removal of the gear box 110.

A spur drive gear 150 is provided on the upper end of the input shaft 19 for engagement with a spur gear 152 of an intermediate compound gear 154. The compound gear 154 is rotatably mounted on a fixed upstanding stub shaft 156 press fit within a mounting aperture 157 in the housing 114 and is axially supported on a thrust washer or bearing 159. The spur gear 152 has sufficient axial length for engagement with a spur gear 158 of the compound gear 120 when the compound gear 120 is in its lower operating position shown in part in full lines in FIG. 2. With the compound gear 120 in its upper operating position shown in part in broken lines in FIG. 2, the spur gear 158 is free of engagement with spur gear 152. The drive gear 150 and gear 158 are coaxial and have the same number of teeth to provide a 1:1 drive from the drive shaft 19 to the variator center shaft 30 with the compound gear 120 in its lower operating position.

The compound gear 120 is adapted to be axially shifted to its upper operating position to shift a spur gear 162 of the compound gear 120 into engagement with a spur gear 164 of the intermediate compound gear 154 whereby the input shaft 19 is connected for driving the variator center shaft 30 via the pairs of intermeshing gears 150, 152 and 164, 162. The overall gear ratio is established to provide a 1:4 step up for converting the conventional gallons system to a quarts system and to provide a 1:3.7857 step up for converting the conventional gallons system to a liters system. (A liter is equal to 1.0567 quarts and the difference between the described 1:3.7857 gear ratio and the required slightly less 1:3.7854 gear ratio is accomodated by adjustment of the meter 16 within its available adjustment range.) For example, the input and output spur gears 150, 158 each have 32 teeth and the intermediate spur gear 152 has 16 teeth to provide a 1:1 drive ratio for gallons computation with the output compound gear 120 in its lower operating position. For converting the computer from gallons to quarts computation, the intermediate spur gear 164 has, for example 32 teeth and the output spur gear 162 has 16 teeth. For conversion from a gallon to a liter unit volume measure, the gears 150, 152, 158, 164 and 162 could, for example, have 53 teeth, 24 teeth, 53 teeth, 36 teeth and 21 teeth respectively for selectively providing a gallons system (with the available 1:1 drive ratio) and a liters system (with the available 1:3.7857 drive ratio).

With the compound gear 120 in its lower operating position, the upper end of the input shaft 19 provides a thrust bearing for supporting the compound gear 120. A suitable spring wire ring 170 which is slightly radially compressed into a peripheral annulus 172 of the bushing 124 bears against the inside surface of the compound gear 120 to frictionally retain the compound gear in its lower operating position.

The compound gear 120 is adapted to be shifted to its alternate upper gear setting by manually axially shifting the input shaft 19 upwardly to lift the compound gear 120 upwardly until the retaining ring 170 is free to snap outwardly slightly to thereby positively hold the compound gear 120 in its upper operating position. Accordingly, the compound gear 120 cannot be shifted back to its lower operating position without removing the gear box 110 from the underside of the variator base 111, thereby making the conversion irreversible without the permission of the authorities applying the seal 142. The input shaft 19 is then manually returned to its lower or normal operating position shown. The retaining ring 134 must be removed for permitting displacing the input shaft 19 upwardly and, after the shaft is returned to its lower operating position, the ring 134 is replaced on the shaft 19 and resealed by the proper authorities. The intermediate gears 152 and 164 are axially spaced to provide for disengagement of the gears 158, 152 before engagement of the gears 162, 164. Also, the variator center shaft 30 may be manually rotated slightly back and forth to facilitate engagement of the gears 162, 164 as the shaft 19 is shifted upwardly to set the gear box 110 at its alternate unit volume measure setting.

Accordingly, with the gear box 110 designed for and set at a 1:4 gear ratio for quart computation, the cost counters 38 provide for registering a cost which is four times the cost which would be registered by a conventional unmodified register. Thus, by setting the variator 20 at one-fourth the price of a gallon of fuel and therefore setting the variator at a unit volume price for a quart of fuel, the cost counter would then properly count and register the cost of fuel. The posted unit volume price provided by the variator price wheels 21–23 accordingly becomes a quart unit volume price. Also, the volume counters 25 provide for registering a volume which is four times the volume given in gallons registered by a conventional unmodified register and therefore register the volume of fuel delivered in quarts. Accordingly, the register cover plate 180 is therefore suitably modified to apply a quart designation to the posted unit volume price and volume readout. Since a quart unit volume price is being used to compute the cost of the gasoline delivered, the computer price range has in effect been expanded by a factor of four and such that the price range of a gallon of gasoline (i.e., the posted quart price times a factor of four) is extended to 199 and 6/10 cents per gallon with the limited range variator previously having a gallon price range to 49 and 9/10 cents and to 399 and 6/10 cents per gallon with the greater range variator previously having a gallon price range to 99 and 9/10 cents.

Similarly, with the gear box designed for and set at a 1:3.7857 gear ratio for liter computation, the cost counters provide for properly registering the cost of the fuel delivered by setting the variator at the appropriate liter unit volume price, the variator price wheels 21–23 thereby providing for posting a liter unit volume price. The volume counters would then register the volume amount of fuel delivered in liters. The variator cover plate 180 would be suitably modified to show that the posted price is the unit volume price for a liter of fuel and the registered volume is provided in liters, and the meter 16 would be adjusted very slightly for accurately converting the computer to the liter system.

The price change from a gallon unit volume price to a unit volume price for a quart, liter or other unit measure less than a gallon can therefore be made without changing the drive connection between the register 26 and the variator center shaft 30 excepting to reduce the cost gear ratio through the variator 20 with the variator range arms. Also, the input coupling 5 is preferably designed as shown to have an elongated coupling slot 9 for receiving the transverse drive pin 7 of the drive coupling member 6 which permits lifting the input shaft 19 sufficiently to shift the gear box 110 without disengaging the drive coupling 5.

In accordance with the present invention, the gear box 110 may be installed in conjunction with the replacement of the conventional gallons meter 16 (having an output shaft 17 driven at the rate of four revolutions per gallon) by a quarts, liters or other alternate unit volume measure meter (having an output shaft driven at the rate of four revolutions for each unit volume measure). In that event, the gear box gearing would be established, for example, to provide a 4:1 gear reduction (with a quarts meter) or a 3.7857:1 gear reduction (with a liters meter) in the lower operating position of the compound gear 120 and a 1:1 gear ratio in the upper operating position of the compound gear and whereby the drive ratio through the gear box 110 would be 1:1 after the conversion to the alternate unit volume measure was made. Of course, other meters could also be employed with the gear box by establishing the proper gear ratios with the gear box 110.

As will be apparent to persons skilled in the art, various modifications, adaptations and variations of the foregoing specific disclosure can be made without departing from the teaching of the present invention.

We claim:

1. Fuel pump computer conversion means for selectively converting the unit volume price and volume registration of a mechanical fuel pump computer from a first to a second unit volume measure having a volumetric ratio of *a*:1; the mechanical fuel pump computer having a variator with a base and a center shaft with a portion depending below the base adapted to be rotated by a fuel meter in accordance with the volume of fuel delivered, the variator being settable for establishing each place of a unit volume fuel price within a multiple place price range and for registering the unit volume price established by the variator setting, and a resettable register having at least one volume counter connected to be driven by the variator center shaft to register the volume of fuel delivered and at least one cost counter connected to be driven by the variator to register the cost of fuel delivered in accordance with the registered volume and the unit volume price established by the variator setting; the fuel pump computer conversion means comprising an auxiliary housing mounted on the underside of the base of the variator about said depending center shaft portion, a rotary output with center shaft drive means mounted on said depending center shaft portion within the housing, a rotary input rotatably mounted on the housing to extend therethrough and having input drive means inside the housing and an outside extension adapted to be rotated by a fuel meter in accordance with the volume of fuel delivered, intermediate rotary drive means mounted within the housing for operatively connecting the rotary input drive means and the rotary output drive means; the input, output and intermediate drive means collectively providing settable drive means manually selectively shiftable from externally of the housing from a first setting establishing a first drive ratio between the rotary input and rotary output, to a second setting establishing a second drive ratio between the rotary input and rotary output, the second and first drive ratios having a relative drive ratio of *a*:1 for registering with the fuel pump computer in said first setting of the settable drive means, the unit volume price and the volume of fuel delivered in said first unit volume measure and the cost of fuel delivered in accordance with the volume and unit volume price in said first unit volume measure, and for registering with the fuel pump computer in said second setting of the settable drive means, the unit volume price and the volume of fuel delivered in said second unit volume measure and the cost of fuel delivered in accordance with the volume and unit volume price in said second unit volume measure, and means inside the auxiliary housing for preventing manually shifting the settable drive means from its said second setting to its said first setting from externally of the housing whereby a fuel pump computer converted by the conversion means is operative to be manually selectively converted once from externally of the housing, from setting a unit volume price in said first to said second unit volume measure, register the volume of fuel delivered in the respective unit volume measure, and register the cost of the fuel delivered in accordance with the registered volume and the unit volume price established by the variator setting.

2. Fuel pump computer conversion means according to claim 1 wherein one of said drive ratios between the rotary input and rotary output is 1:1.

3. Fuel pump computer conversion means according to claim 1 wherein said first drive ratio is 1:1.

4. Fuel pump computer conversion means according to claim 1 wherein said rotary output comprises an elongated collar mounted on the depending center shaft portion with the collar depending below the center shaft, wherein the output drive means comprises output gear means mounted on the collar and axially shiftable thereon between a first lower operating position at least substantially below the variator center shaft and providing said first setting and a second upper operating position providing said second setting, wherein the rotary input drive means comprises input gear means and wherein the intermediate rotary drive means comprises intermediate gear means engageable by the input gear means to be driven thereby and selectively engageable by the output gear means as it is shifted from its first to its second operating position.

5. Fuel pump computer conversion means according to claim 1 wherein the rotary output drive means is axially shiftable on the variator center shaft from a first to a second operating position thereof to shift the settable drive means from its said first setting to its said second setting, wherein the rotary input is mounted on the housing substantially coaxially with the rotary output and to be axially shiftable between a first extended position and a second withdrawn position, the rotary input and the rotary output drive means having cooperating means for axially shifting the rotary output drive means from its said first operating position to its said second operating position by axially shifting the rotary input from its said first extended position to its said second withdrawn position.

6. Fuel pump computer conversion means according to claim 5 wherein the rotary input drive means comprises an input drive gear, wherein the axially shiftable rotary output drive means comprises an output compound gear axially shiftable on the variator center shaft between said first and second operating positions, and wherein the intermediate rotary drive means comprises intermediate gear means driven by the input drive gear and engageable by the output compound gear in its first operating position to provide said first drive ratio and by the compound gear in its second operating position to provide said second drive ratio.

7. Fuel pump computer conversion means according to claim 5 wherein said means for preventing manually shifting the settable drive means comprises locking means for locking the rotary output drive means in its said second axial operating position, the rotary input being shiftable back to its first extended position after the rotary output drive means is shifted to its said second operating position.

8. Fuel pump computer conversion means according to claim 7 wherein said outside extension of the rotary input comprises a coupling member for connecting the rotary input to a fuel meter and having elongated coupling means permitting the rotary input to be axially shifted from its first extended position to its second withdrawn position and back to its first extended position without disconnecting the rotary input from the fuel meter.

9. Fuel pump computer conversion means according to claim 1 wherein the rotary input is rotatably mounted on the housing with its axis substantially parallel to the axis of the variator center shaft, wherein the conversion means further comprises a stub shaft fixed within the housing with its axis parallel to the rotary input, and wherein the intermediate rotary drive means is rotatably mounted on the stub shaft.

10. Fuel pump computer conversion means for selectively converting the unit volume price and volume registration of a mechanical fuel pump computer from a first to a second unit volume measure having a volumetric ratio of $a:1$; the mechanical fuel pump computer having a variator with a base and a center shaft with a portion depending below the base adapted to be rotated by a fuel meter in accordance with the volume of fuel delivered, the variator being settable for establishing each place of a unit volume fuel price within a multiple place price range and for registering the unit volume price established by the variator setting, and a resettable register having at least one volume counter connected to be driven by the variator center shaft to register the volume of fuel delivered and at least one cost counter connected to be driven by the variator to register the cost of fuel delivered in accordance with the registered volume and the unit volume price established by the variator setting; the fuel pump computer conversion means comprising an auxiliary housing mounted on the underside of the base of the variator with said depending center shaft portion enclosed therein, a rotary output with center shaft drive means mounted on said depending center shaft portion and within the housing, a rotary input rotatably mounted on the housing to extend therethrough and having input drive means inside the housing and an outside extension adapted to be rotated by a fuel meter in accordance with the volume of fuel delivered, and intermediate rotary drive means mounted within the housing for operatively connecting the rotary input drive means and the rotary output drive means; the input, output and intermediate drive means collectively providing settable drive means manually selectively shiftable from externally of the housing from a first setting establishing a first drive ratio between the rotary input and rotary output, to a second setting establishing a second drive ratio between the rotary input and rotary output, the second and first drive ratios having a relative drive ratio of $a:1$ for registering with the fuel pump computer in said first setting of the settable drive means the unit volume price and the volume of fuel delivered in said first unit volume measure and the cost of fuel delivered in accordance with the volume and unit volume price in said first unit volume measure, and for registering with the fuel pump computer in said second setting of the settable drive means the unit volume price and the volume of fuel delivered in said second unit volume measure and the cost of fuel delivered in accordance with the volume and unit volume price in said second unit volume measure, the rotary output drive means being axially shiftable on the variator center shaft from a first to a second operating position thereof to shift the shiftable drive means from its said first setting to its said second setting, means for retaining the rotary output drive means in its second operating position, the rotary input being mounted on the housing substantially coaxailly with the rotary output and to be axially shiftable from a first extended normal position to a second withdrawn position and back to its first extended normal position, the rotary input and the rotary output drive means having cooperating means for axially shifting the rotary output drive means from its said first operating position to its said second operating position by axially shifting the rotary input from its said first extended normal position to its said second withdrawn position.

* * * * *